US007748073B2

(12) United States Patent
Nguyen

(10) Patent No.: US 7,748,073 B2
(45) Date of Patent: Jul. 6, 2010

(54) SWEEPING DEVICE

(76) Inventor: Manh T. Nguyen, 12542 Leaders St., Houston, TX (US) 77072

( * ) Notice: Subject to any disclaimer, the term of this patent is extended or adjusted under 35 U.S.C. 154(b) by 1215 days.

(21) Appl. No.: 11/267,121

(22) Filed: Nov. 5, 2005

(65) Prior Publication Data

US 2007/0101528 A1 May 10, 2007

(51) Int. Cl.
*A46B 3/00* (2006.01)
*A46B 9/00* (2006.01)

(52) U.S. Cl. ..... 15/189; 15/144.4; 15/159.1; 15/207.2

(58) Field of Classification Search ..... 15/159.1, 15/189, 144.4, 207.2
See application file for complete search history.

(56) References Cited

U.S. PATENT DOCUMENTS

| | | | | | |
|---|---|---|---|---|---|
| 36,560 | A * | 9/1862 | Dickinson | ..... | 15/189 |
| 112,976 | A * | 3/1871 | Stackpole | ..... | 15/189 |
| 246,500 | A * | 8/1881 | Hall | ..... | 15/189 |
| 554,214 | A * | 2/1896 | Bowell | ..... | 15/114 |
| 1,761,101 | A * | 6/1930 | Blood | ..... | 15/159.1 |
| 1,955,034 | A * | 4/1934 | Struve | ..... | 15/159.1 |
| 3,029,455 | A * | 4/1962 | Siculan | ..... | 15/159.1 |
| 4,222,562 | A * | 9/1980 | Gardner | ..... | 273/129 K |
| 5,970,563 | A * | 10/1999 | Monahan | ..... | 15/189 |
| 6,571,416 | B2 * | 6/2003 | Hirse | ..... | 15/106 |

* cited by examiner

*Primary Examiner*—Randall Chin
(74) *Attorney, Agent, or Firm*—Delphine James

(57) ABSTRACT

The present invention is an apparatus for sweeping the indoor or outdoor floors. In one embodiment the apparatus includes a telescoping elongated handle with an attached sweeping member. The sweeping member is made of several layers of Vietnam Dot' Grass which is secured to the lower end of the elongated handle. The lower edge of the grass is cut in the shape of an arc. In another embodiment of the present invention, the elongated stalk of the grass is secured around the elongated handle. The lower edge of the grass of this embodiment is cut in the shape of an one-half arc shape.

4 Claims, 5 Drawing Sheets

SWEEPING DEVICE

BACKGROUND

The present invention relates to an plement used for sweeping indoor or outdoor floors. Brooms have been used for centuries since before the 1700's, Initially brooms were made by tying straw, hay, or corn husks to handle. Commercial brooms are made from various types of plants. More patticularly most commercial brooms are made of the broom-corn plant, The broom consists of a long handle with series of broom-corm attached to the lower end of the handle. However, the fibers of the broom-corm are stiff and not very flexible. Because of the lack of flexibility of the common household broom sweeping very fine small particles into a small pile of debris for collection becomes very difficult task. The unique design of the present invention solves the problem as stated above. The present invention is a unique type of broom designed with Vietnam Dot Grass as bristles of the broom.

SUMMARY

One of the main objectives of the present invention is to provide a broom with a sweeping member that is flexible and can be used to sweep very small particles of dust and debris into a pile for collection. The present invention is an apparatus for sweeping the indoor or outdoor floors. In one embodiment the apparatus includes a telescoping elongated handle with an attached sweeping member, The sweeping member is made, of several layers of Vietnam's Dot' Grass which is secured to the lower end of the elongated handle. The lower edge of the grass is cut in the shape of an arc. In another embodiment of the present invention, the elongated stalk of the grass is secured around the elongated handle, The lower edge of the grass of this embodiment is cut in the shape of a one-half arc shape.

Further advantages of the present invention will become apparent after reading the detailed description in conjunction with the attached drawings.

DETAILED SPECIFICATIONS

Figure 1:
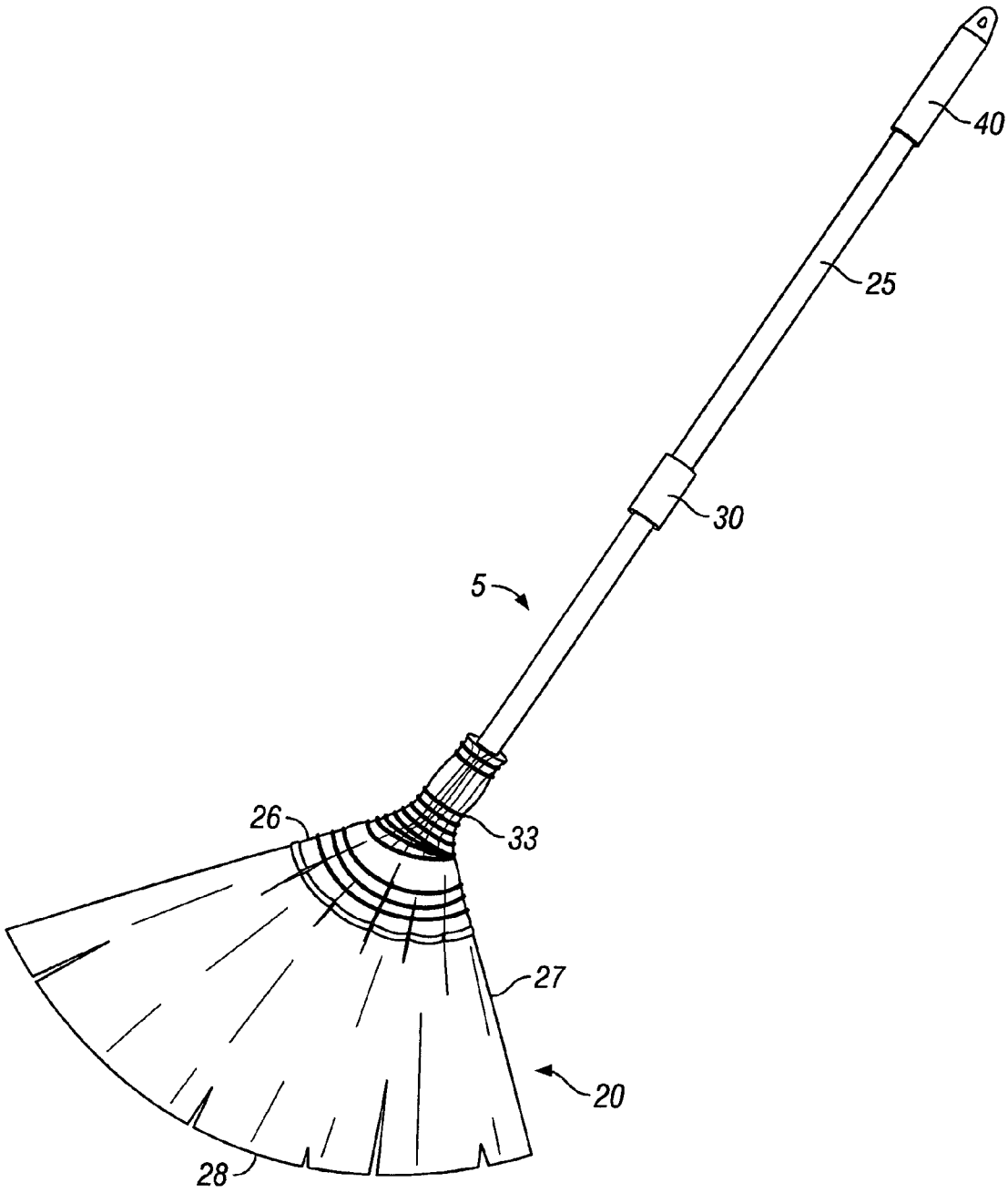
FIG. 1 is a frontal perspective view of the sweeper device of the present invention.
Figure 2:
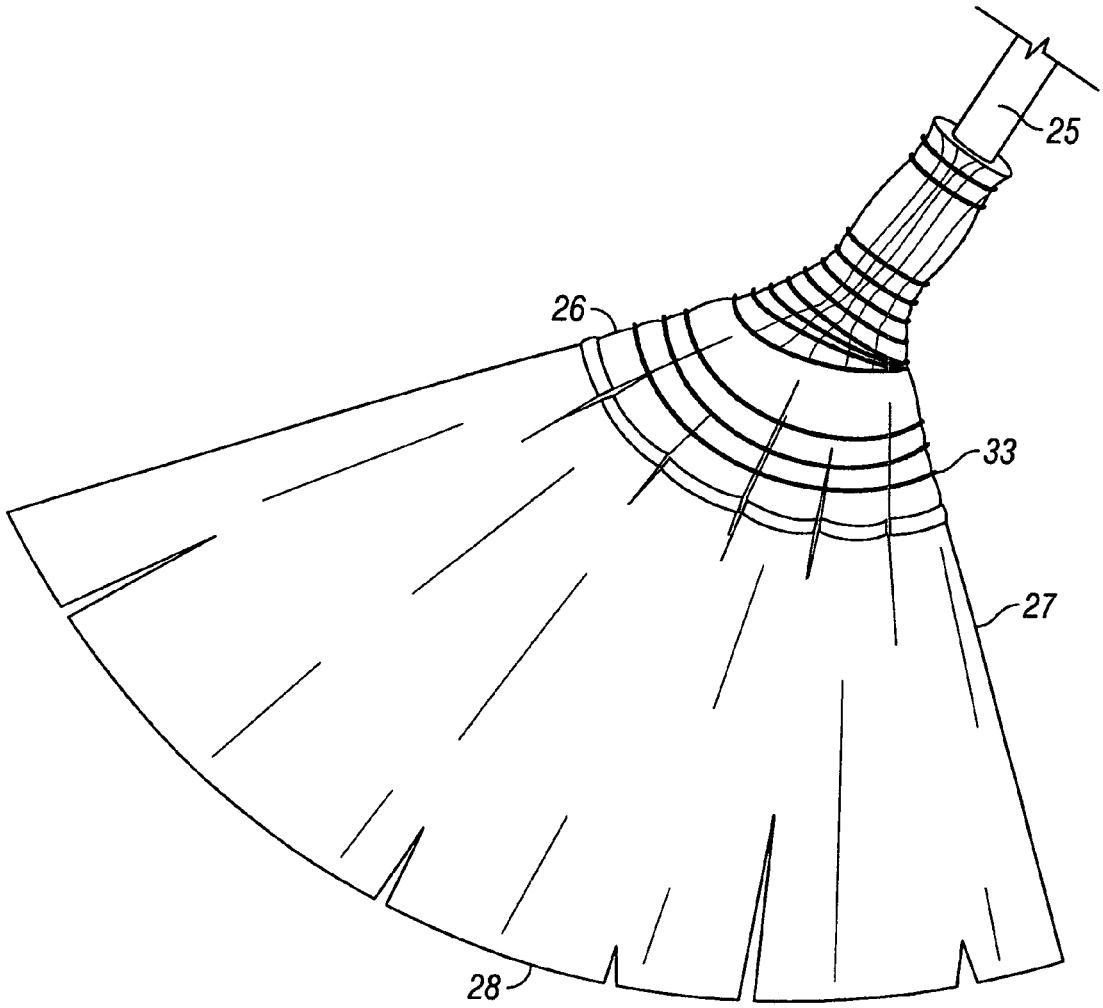
FIG. 2 is an enlarged view of the sweeper member of the sweeper device.

Referring to FIGS. 1 and 2, there is shown one embodiment the present invention a combination sweeper device 5. The sweeper device 5 further comprises a handle 25 and a sweeper member 20.

As shown, handle (25) is elongated and cylindrical in shape. Handle 25 can be made of a sturdy plastic or wood material and can vary in size and length, Telescoping mechanism (30) can be incorporated at an intermediate, location allowing the handle (25) to be increased or reduced to a desired length. In use, telescoping mechanism 30 allows the sweeping member to be extended to reach upper walls and ceilings. In the retracted position, handle 25 allows broom apparatus to be used as a standard broom.

As shown in FIG. 1, sweeper device 5 can further include hand grip member (40). Hand grip member (40) is affixed to the upper end of the handle (25). Additionally, hand grip member (40) an have. indentations to support several of the fingers. In uses hand grip member (40) prevents the handle (25) from slipping when handling sweeper device 5. Hand grip member (40) can be made of a plastic material wit friction absorbing material attached thereto.

Figure 6:
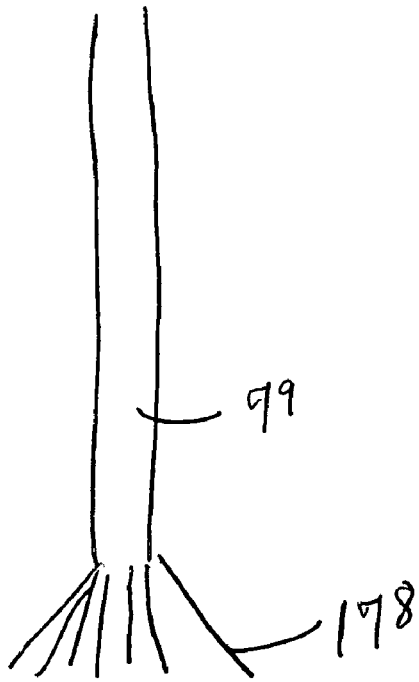
FIG. 6 is a frontal view of the Vietnam Dot' grass.

The bristles of sweeper member 20 are made from a plant known as Vietnam's Dot' grass. As shown in FIG. 6, the fibers 178 of the Vietnam Dot' grass are thin, flexible and strong. As shown in FIG. 1, a plurality of grass fibers is layered surrouding the lower end of handle 25. Then, the grass fibers are secured to the lower end of handle 25 as shown using wire (33) or another suitable fastening material, From the lower end of handle 25, the opposing sides (26, 27) of sweeper member 20 extend outwardly in an obtuse angular configuration. The lower edges (28) of the bundle of fibers of sweeper member 20 flares outward into an arc configuration that is broad and thicker at the center and thinner out at the opposing edges. As depicted, sweeper member 20 has a fan like configuration. In use, because of the flexibility of the fibers of the grass, sweeper member (20) easily bends forward in all directions allowing small fine particles to be swept and collected into a pile of debris.

Figure 3:
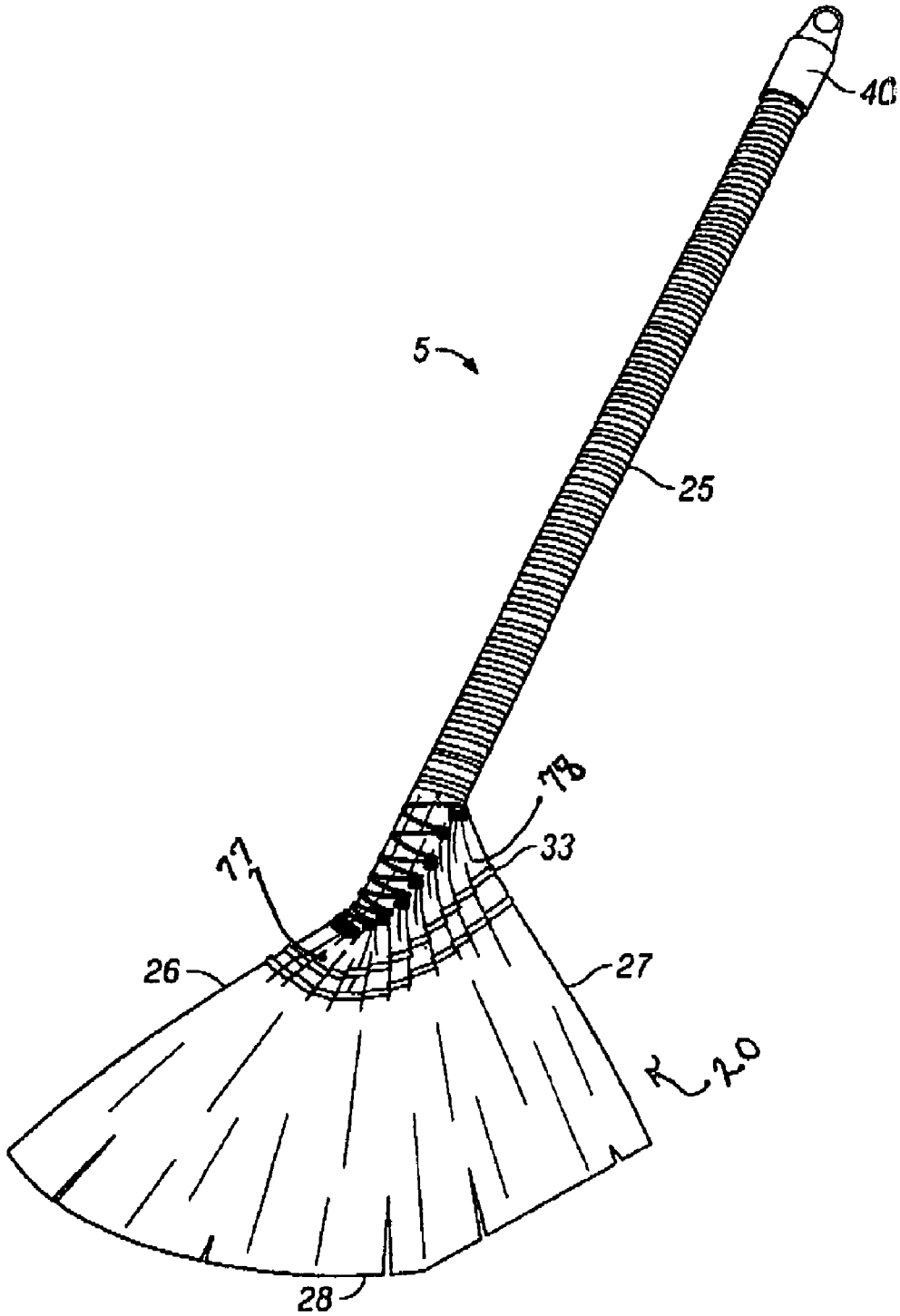
FIG. 3 is a frontal perspective view of an alternative embodiment of the sweeper device of the present invention.
Figure 4:
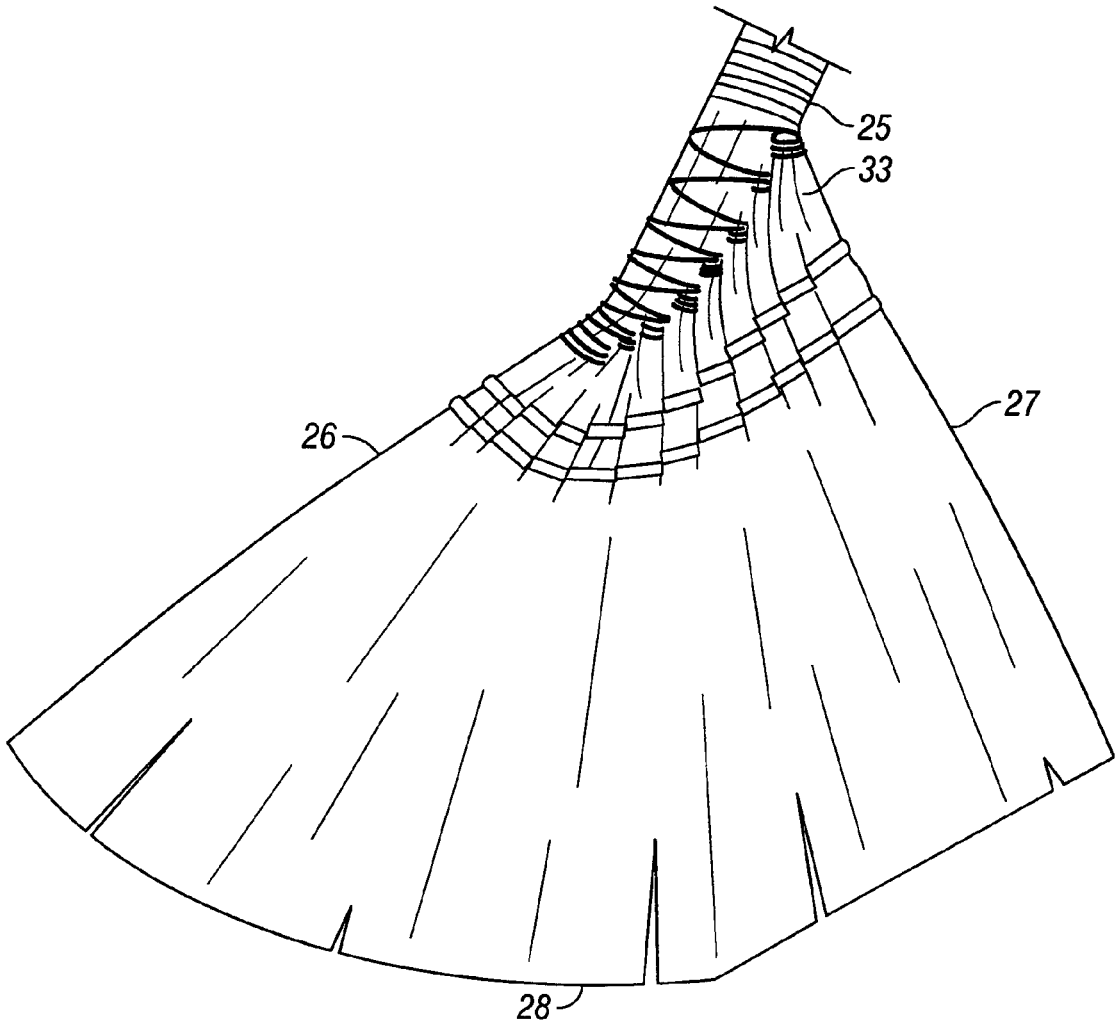
FIG. 4 is an enlarged view of the alternative embodiment of the sweeper member of the sweeper device.

Referring to FIGS. 3 and 4 there is shown an alternative embodiment of the sweeper device 5. In this embodiment, the sweeper device 5 further comprises a handle 25 and a sweeper member 20.

Figure 5:
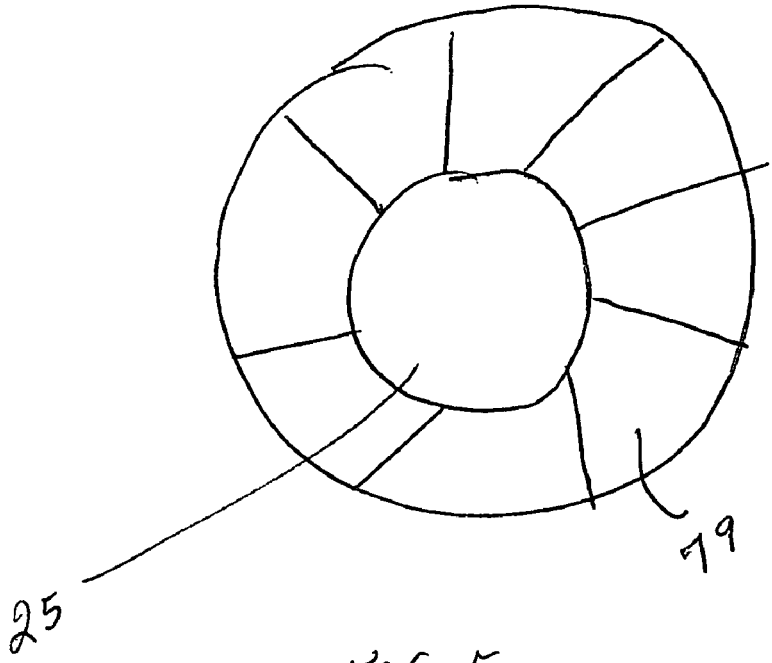
FIG. 5 is a cross sectional view of the handle of the alternative embodiment of FIG. 3.

As shown, handle (25) is elongated and cylindrical in shape. Handle 25 can be made of a sturdy plastic or wood material. In a this configuration, the, stems 79 of plurality of Vietnam's Dot' grass supporting sweeper member 20 extend upward to surround the handle 25 and are secured thereto. As shown in FIG. 5, the stems are encircled from the upper end of the handle 25 to the lower end of handle 25 and are secured by suitable means such as tape or sealing material.

As shown in FIG. 3, sweeper device 5 can further include hand grip member (40). Hand grip member (40) is affixed to the upper end of the handle (25). Additionally, hand grip member (40) can have indentations to support several of the fingers. In use, Hand grip member (40) prevents the handle (25) from slipping when handling sweeper device 5. Hand grip member (40) can be made of a plastic material with friction absorbing material attached thereto.

The bristles of sweeper member 20 are made from a plant known as Vietnam's Dot' grass. As depicted in FIG. 6, the fibers 178 of the Vietnam's Dot' grass are thin, flexible and strong. As shown 3, a plurality of grass fibers is layered surrounding the lower end of handle 25. Then, the, grass fibers are secured to the lower end of handle 25 as shown using wire 33 or another suitable fastening material. First portion (77) of the grass fibers encircles the lower end of handle 25. Linearly upward a predetermined distance from the lower end of handle 25, a second portion 78 of the fibers am layered and connected. From the lower end of handle 25, first side 26 of sweeper member 20 extends outwardly in an obtuse angular fan like configuration. Linearly upward a predetermined distance, second opposing side 27 of sweeper member 20, extends outwardly in an obtuse angular fan like configuration. The lower edges 28 of the bundle of fibers of sweeper member 20 flares outward into an arc configuration that is broad and thicker at the, center and thinner out at the opposing edges. As depicted, sweeper member 20 has a fan like configuration. In use, because of the flexibility of the fibers of the grass, sweeper member (20) easily bonds forward in all directions allowing small fine particles to be swept and collected into a pile of debris.

What is claimed is:

1. A sweeping device comprising;

an elongated handle having a mechanism for varying the length of the handle, the handle defined by an upper end and a lower end;

a sweeper member having bristles formed by a plurality of layered Vietnam Dot' grass fibers, the sweeper member further defined by a first portion of layered fibers and a second portion of layered fibers;

the first portion of layered fibers encircling the lower end of the handle and is secured thereto, a first side edge of sweeper member extending outward from the lower end of the handle;

the second portion of layered fibers extending upward from the lower end of the handle to a predetermined distance and being secured thereto, the second portion of layered grass fibers encircling the lower end of the handle in an arc extending from the lower end of the handle to the predetermined distance upward therefrom, a second side edge of sweeper member extending outward from the predetermined distance from the lower end of the handle;

the first side edge and the second side edge of the sweeper member each extending outwardly in an obtuse angular configuration from the lower end of the handle and terminating in a second lower end, with a peripheral lower edge extending from the second lower end of the first side edge to the second lower end of the second side edge; and the Vietnam Dot' grass fibers being thin, flexible, and easily bendable in all directions wherein the bristles of the sweeper member easily flex to sweep smaller fine particles of dust into a pile of debris.

2. The device of claim 1 further comprising a hand grip member affixed to the upper end of the handle.

3. The device of claim 2 wherein the hand grip member further comprises indentations to support at least one of the fingers of a user's hand.

4. The device of claim 1 wherein the mechanism for varying the length of the handle comprises:

a telescoping mechanism for adjustably increasing and reducing the length of the handle; and the telescoping mechanism being incorporated at a predetermined location on the handle.

* * * * *